US009670791B2

(12) United States Patent
Broomer et al.

(10) Patent No.: US 9,670,791 B2
(45) Date of Patent: Jun. 6, 2017

(54) FLEXIBLE FINGER SEAL FOR SEALING A GAP BETWEEN TURBINE ENGINE COMPONENTS

(71) Applicant: United Technologies Corporation, Hartford, CT (US)

(72) Inventors: Mark Broomer, Portsmouth, NH (US); Carson A. Roy Thill, South Berwick, ME (US); Timothy M. Davis, Kennebunk, ME (US); Anthony P. Cherolis, Hartford, CT (US); Robert L. Hazzard, Windsor, CT (US); Craig R. McGarrah, Southington, CT (US); Conway Choung, Manchester, CT (US); Russell E. Keene, Arundel, ME (US)

(73) Assignee: United Technologies Corporation, Farmington, CT (US)

( * ) Notice: Subject to any disclaimer, the term of this patent is extended or adjusted under 35 U.S.C. 154(b) by 0 days.

(21) Appl. No.: 14/772,194

(22) PCT Filed: Mar. 4, 2014

(86) PCT No.: PCT/US2014/020342

§ 371 (c)(1),
(2) Date: Sep. 2, 2015

(87) PCT Pub. No.: WO2014/138078

PCT Pub. Date: Sep. 12, 2014

(65) Prior Publication Data

US 2016/0003081 A1 Jan. 7, 2016

Related U.S. Application Data

(60) Provisional application No. 61/772,305, filed on Mar. 4, 2013.

(51) Int. Cl.
*F16J 15/32* (2016.01)
*F01D 25/30* (2006.01)
(Continued)

(52) U.S. Cl.
CPC ..... *F01D 11/08* (2013.01); *F01D 5/14* (2013.01); *F01D 9/02* (2013.01); *F01D 11/003* (2013.01); *F01D 11/005* (2013.01); *F01D 25/246* (2013.01)

(58) Field of Classification Search
CPC ..... F01D 11/08; F01D 11/003; F01D 11/005; F01D 5/14; F01D 9/02; F01D 25/246; F16J 15/0887
See application file for complete search history.

(56) References Cited

U.S. PATENT DOCUMENTS 4,110,972 A 9/1978 Young et al.
4,309,145 A 1/1982 Viola
(Continued)

FOREIGN PATENT DOCUMENTS

EP 1239118 5/2010

*Primary Examiner* — Gilbert Lee
(74) *Attorney, Agent, or Firm* — O'Shea Getz P.C.

(57) ABSTRACT

An assembly for a turbine engine includes a turbine engine first component, a turbine engine second component and a flexible seal that is attached to the first component. The flexible seal at least partially seals a gap between the first component and the second component. The flexible seal includes a mount and a finger seal that sealingly engages the second component. The mount includes a boss that sealingly engages the first component.

20 Claims, 4 Drawing Sheets

(51) Int. Cl.

| | |
|---|---|
| ***F01D 11/08*** | (2006.01) |
| ***F01D 11/00*** | (2006.01) |
| ***F01D 5/14*** | (2006.01) |
| ***F01D 9/02*** | (2006.01) |
| *F01D 25/24* | (2006.01) |

(56) References Cited

U.S. PATENT DOCUMENTS

| | | | | |
|---|---|---|---|---|
| 4,575,006 | A | 3/1986 | Madden | |
| 4,668,164 | A | 5/1987 | Neal et al. | |
| 4,783,085 | A | 11/1988 | Wicks et al. | |
| 4,961,588 | A | 10/1990 | Brienza | |
| 5,115,979 | A | 5/1992 | Ellerhorst et al. | |
| 5,215,257 | A | 6/1993 | Barcza | |
| 5,524,846 | A | 6/1996 | Shine et al. | |
| 5,683,034 | A | 11/1997 | Johnson et al. | |
| 6,357,672 | B1 | 3/2002 | Cowan et al. | |
| 7,775,048 | B2 | 8/2010 | Grammel, Jr. | |
| 7,874,160 | B2 | 1/2011 | Swanson et al. | |
| 8,020,386 | B2 | 9/2011 | Cowan et al. | |
| 2006/0197287 | A1 | 9/2006 | Farah et al. | |
| 2015/0330239 | A1* | 11/2015 | Vo | F01D 11/001 415/173.1 |
| 2015/0354384 | A1* | 12/2015 | Budnick | F01D 11/005 415/111 |
| 2015/0354386 | A1* | 12/2015 | Chuong | F01D 25/30 415/182.1 |
| 2015/0369409 | A1* | 12/2015 | Broomer | F01D 11/003 285/189 |

* cited by examiner

FLEXIBLE FINGER SEAL FOR SEALING A GAP BETWEEN TURBINE ENGINE COMPONENTS

This application claims priority to PCT Patent Application No. PCT/US14/20342 filed Mar. 4, 2014, which claims priority to U.S. patent application Ser. No. 61/772,305 filed Mar. 4, 2013.

BACKGROUND OF THE INVENTION

1. Technical Field

This disclosure relates generally to a turbine engine and, more particularly, to a finger seal for sealing a gap between a plurality of turbine engine components.

2. Background Information

Various types of seals are known in the art for reducing gas leakage between adjacent components of a turbine engine. Many of these seals, however, are unable to adequately accommodate thermal expansion and contraction of the engine components, which may increase gas leakage between the components. For example, where a seal land of one of the engine components deforms more than the seal, gas may leak between the seal land and the seal.

There is a need in the art for an improved seal for a turbine engine.

SUMMARY OF THE DISCLOSURE

According to an aspect of the invention, an assembly for a turbine engine is provided that includes a turbine engine first component, a turbine engine second component and a flexible seal that is attached to the first component. The flexible seal at least partially seals a gap between the first component and the second component. The flexible seal includes a mount and a finger seal that sealingly engages the second component. The mount includes a boss that sealingly engages the first component.

According to another aspect of the invention, an assembly for a turbine engine is provided that includes a turbine engine first component, a turbine engine second component, a flexible seal and a fastener. The flexible seal at least partially seals a gap between the first component and the second component. The flexible seal includes a mount and a finger seal. The finger seal sealingly engages the second component, and is cantilevered from the mount. The mount includes a base and a washer, which is sealingly engaged between the base and a flange of the first component. The fastener attaches the mount to the flange, and extends through the washer and the base.

According to still another aspect of the invention, an assembly for a turbine engine is provided that includes a flexible seal that extends circumferentially at least partially around an axis. The flexible seal includes a mount and a finger seal. The mount includes a base, a plurality of bosses and a plurality of fastener apertures. The base extends radially between an inner end and an outer end. The bosses are arranged circumferentially around the axis. Each of the fastener apertures extends axially through the base and a respective one of the bosses. The finger seal is arranged at the inner end, and is cantilevered from the mount.

The washer may be bonded or otherwise attached to the base and forms a boss.

The mount may include a retainer and a channel that extends radially between a first of the bosses and the retainer. The retainer may have an axial thickness that is less than an axial thickness of the first of the bosses.

The mount may include a second retainer and a second channel that extends radially between the first of the bosses and the second retainer. The second retainer may have an axial thickness that is less than the axial thickness of the first of the bosses.

The assembly may include a fastener that attaches the mount to the first component and extends through the boss.

The boss may be configured as or otherwise include a first boss. The mount may also include a base and a second boss. The first boss and/or the second boss may be arranged on opposing sides of the base. The fastener may extend through the base and the second boss.

The mount may include a base. The boss may be configured as or otherwise include a washer that is bonded to the base.

The assembly may include a washer that is sealingly engaged between a flange and a first shoulder. The first component may include the flange. The fastener may include the first shoulder and a second shoulder that sealingly engages the mount. The fastener may attach the mount to the flange. The fastener may extend through mount, the flange and the washer between the first shoulder and the second shoulder. The fastener may include a nut and a bolt. One of the shoulders may be defined by a surface of the nut, and another one of the shoulders may be defined by a surface of a head of the bolt. Alternatively, the shoulders may be defined by surfaces of a rivet or any other type of fastener.

The assembly may include a second fastener that attaches the mount to the first component. The fastener may have a shaft diameter that is approximately equal to a shaft diameter of the second fastener. The fastener may extend through a first aperture in the first component. The second fastener may extend through a second aperture in the first component. The first aperture may have a diameter that is different than a diameter of the second aperture.

The assembly may include a first flange and a second flange. The first component may include the first flange, and the first flange may be arranged between the second flange and the mount. The fastener may connect the first flange, the second flange and the mount together.

The finger seal may be cantilevered from the mount.

The flexible seal may be one of a plurality of flexible seals that are attached to the first component and arranged circumferentially around an axis.

A first of the flexible seals may engage a second of the flexible seals through a seal joint.

The assembly may include a gasket that is sealingly engaged between the first component and the mount. The mount may extend radially between a first end and a second end. The gasket may be located radially between the first end and the boss.

The assembly may include a second gasket that is sealingly engaged between the first component and the mount. The second gasket may be located radially between the second end and the boss.

The mount may include a retainer. A gap may extend axially between the first component and the retainer. The gasket may be arranged radially between the boss and the retainer.

The first component may be configured as or otherwise include a first turbine engine case. Alternatively, the first component may be configured as or otherwise include blade outer air seal (BOAS) and/or any other component of a turbine engine. The second component may be configured as or otherwise include a second turbine engine case. Alternatively, the second component may be configured as or otherwise include any other component of a turbine engine.

The foregoing features and the operation of the invention will become more apparent in light of the following description and the accompanying drawings.

DETAILED DESCRIPTION OF THE INVENTION

Figure 1:
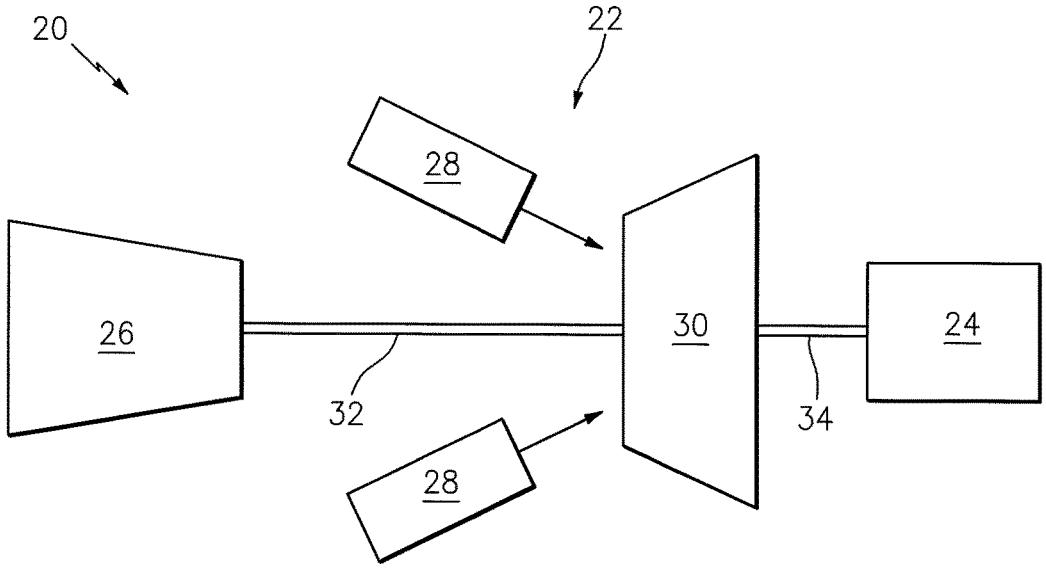
FIG. 1 is a schematic illustration of a system with an industrial turbine engine and an electrical generator.

FIG. 1 is a schematic illustration of a system 20 that includes an industrial turbine engine 22 and an electrical generator 24. The turbine engine 22 may be configured for a land based installation, and includes a compressor 26, one or more combustors 28 and a turbine 30. The compressor 26 is connected to and driven by the turbine 30 through an engine shaft 32. The combustors 28 are arranged about the engine shaft 32, and are fluidly coupled between the compressor 26 and the turbine 30. The electrical generator 24 is connected to and driven by the turbine 30 through a shaft 34.

Figure 2:
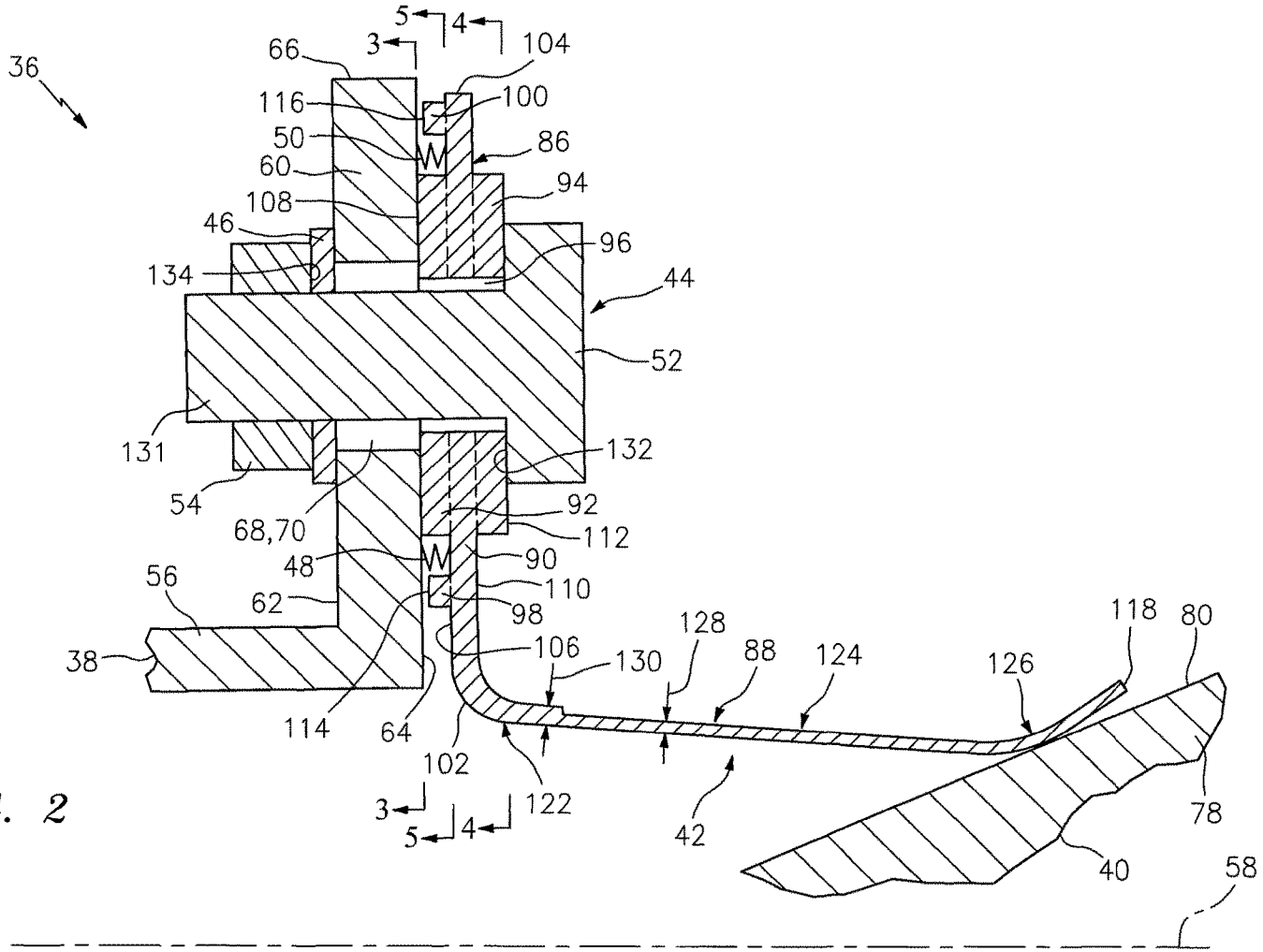
FIG. 2 is a side-sectional illustration of a portion of a seal assembly for the turbine engine of FIG. 1.

FIG. 2 is a side sectional illustration of a portion of an assembly 36 for the turbine engine 22 of FIG. 1. The assembly 36 includes a turbine engine first component 38, a turbine engine second component 40, and one or more flexible seals 42 that at least partially seal a gap (e.g., an annular gap) between the first and the second components 38 and 40. The assembly 36 may also include one or more fasteners 44, one or more washers 46, and/or one or more gaskets 48 and 50. One or more of the fasteners 44 may each include a bolt 52 and a nut 54.

Figure 3:
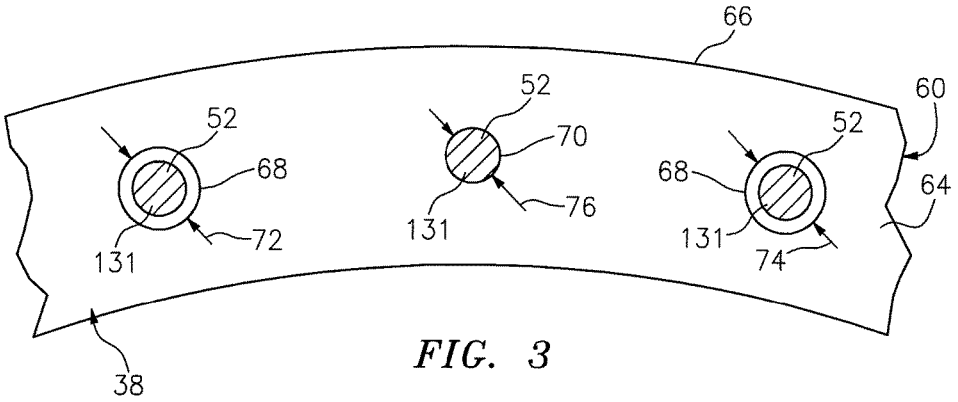
FIG. 3 is a cross-sectional illustration of a portion of the seal assembly of FIG. 2.

The first component 38 may be configured as a turbine engine case that houses, for example, at least a portion of the turbine 30. Alternatively, the first component 38 may be configured as any other component within the turbine engine 22. The first component 38 includes a body 56 (e.g., a tubular shell) that extends along an axis 58 to a flange 60 (e.g., annular flange). The flange 60 extends axially between a flange first surface 62 and a flange second surface 64. The flange 60 extends radially out from the body 56 to a flange end 66. Referring to FIGS. 2 and 3, the flange 60 extends circumferentially around the axis 58. The first component 38 includes one or more fastener apertures, which may include one or more first apertures 68 and one or more second apertures 70. The fastener apertures 68 and 70 are arranged circumferentially around the axis 58. One or more of the fastener apertures 68, 70 each extends axially through the flange 60 between the first and the second surfaces 62 and 64. Referring to FIG. 3, one or more of the first apertures 68 each have a first diameter 72, which is greater than a shaft diameter 74 of the bolts 52. One or more of the second apertures 70 each have a second diameter 76 that is less than the first diameter 72. Alternatively, the second diameter 76 may be substantially equal to or greater than the first diameter 72.

Referring to FIG. 2, the second component 40 may be configured as a duct within the turbine 30. Alternatively, the second component 40 may be configured as a turbine engine case that houses, for example, at least a portion of the turbine 30, or any other component within the turbine engine 22. The second component 40 includes a body 78 (e.g., a tubular shell) having an outer seal land 80 (e.g., an annular surface). The seal land 80 may radially taper as the seal land 80 extends axially towards the first component 38. The seal land 80 extends circumferentially around the axis 58.

Figure 4:
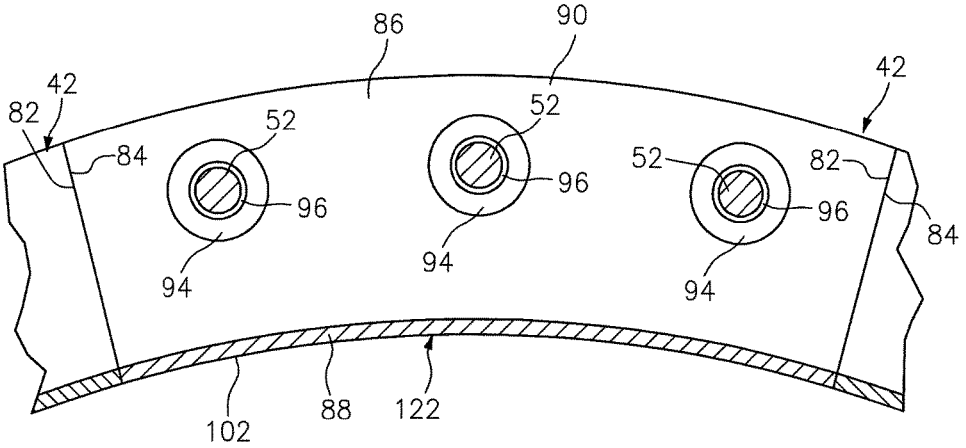
FIG. 4 is another cross-sectional illustration of a portion of the seal assembly of FIG. 2.

Referring to FIGS. 2 and 4, one or more of the flexible seals 42 each extends circumferentially around the axis 58 between a seal first side 82 and a seal second side 84. One or more of the flexible seals 42 each includes a mount 86 and a finger seal 88.

The mount 86 includes a base 90 (e.g., an arcuate plate), one or more bosses 92 and 94, and one or more fastener apertures 96. The mount 86 may also include one or more retainers 98 and 100 (e.g., arcuate tabs).

The base 90 extends radially between a base inner end 102 and a base outer end 104. The base 90 extends circumferentially between the first side 82 and the second side 84.

Figure 5:
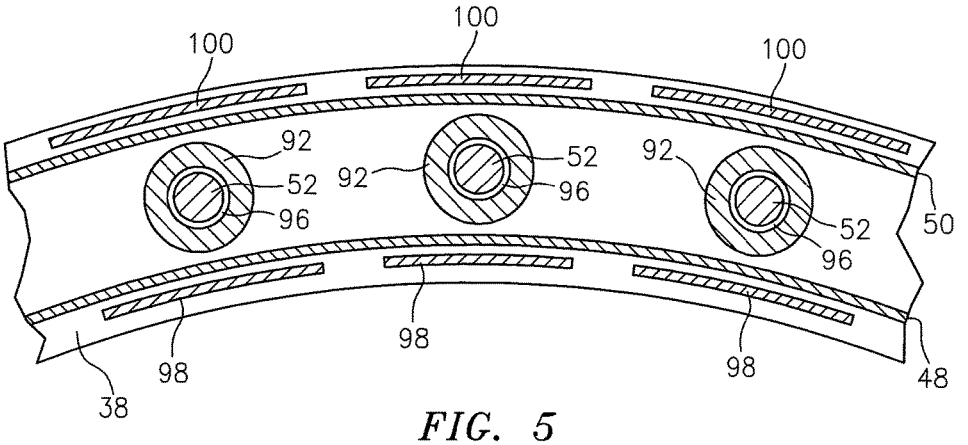
FIG. 5 is another cross-sectional illustration of a portion of the seal assembly of FIG. 2.

Referring to FIGS. 2, 4 and 5, the bosses include one or more first bosses 92 and one or more second bosses 94. The first and the second bosses 92 and 94 are respectively arranged circumferentially around the axis 58. The first bosses 92 are arranged radially between the inner retainers 98 and the outer retainers 100. Referring to FIG. 2, one or more of the first bosses 92 each extends axially from a first side 106 of the base 90 to a respective first boss surface 108, thereby defining a boss axial thickness. One or more of the second bosses 94 each extends axially from a second side 110 of the base 90 to a respective second boss surface 112, where the base second side 110 is arranged opposite of the base first side 106.

One or more of the bosses 92 and/or 94 may be configured integral with the base 90. The base 90, first bosses 92 and/or the second bosses 94, for example, may be cast, milled, machined and/or otherwise formed as a unitary body. One or more of the bosses 92 and/or 94 may alternatively be configured as discrete elements (e.g., washers), which are welded, brazed, adhered and/or otherwise bonded or attached to the base 90.

The fastener apertures 96 are respectively arranged with the bosses 92 and 94. One or more of the fastener apertures 96 each extends axially through the mount 86 from a respective one of the first boss surfaces 108 to a respective one of the second boss surfaces 112. More particularly, the fastener apertures 96 respectively extend axially through the first bosses 92, the base 90 and the second bosses 94.

Referring to FIGS. 2 and 5, the retainers include one or more inner retainers 98 and one or more outer retainers 100. The inner retainers 98 are located radially between the base inner end 102 and the first bosses 92. The outer retainers 100 are located at (e.g., on, adjacent or proximate) the base outer end 104. Referring to FIG. 2, one or more of the inner retainers 98 each extends axially from the base first side 106 to a respective retainer surface 114, thereby defining an inner retainer axial thickness. This inner retainer axial thickness may be less than the axial thickness of one or more of the first bosses 92. One or more of the outer retainers 100 each extends axially from the base first side 106 to a respective retainer surface 116, thereby defining an outer retainer axial thickness. This outer retainer axial thickness that may be less than the axial thickness of one or more of the first bosses 92.

Figure 6:
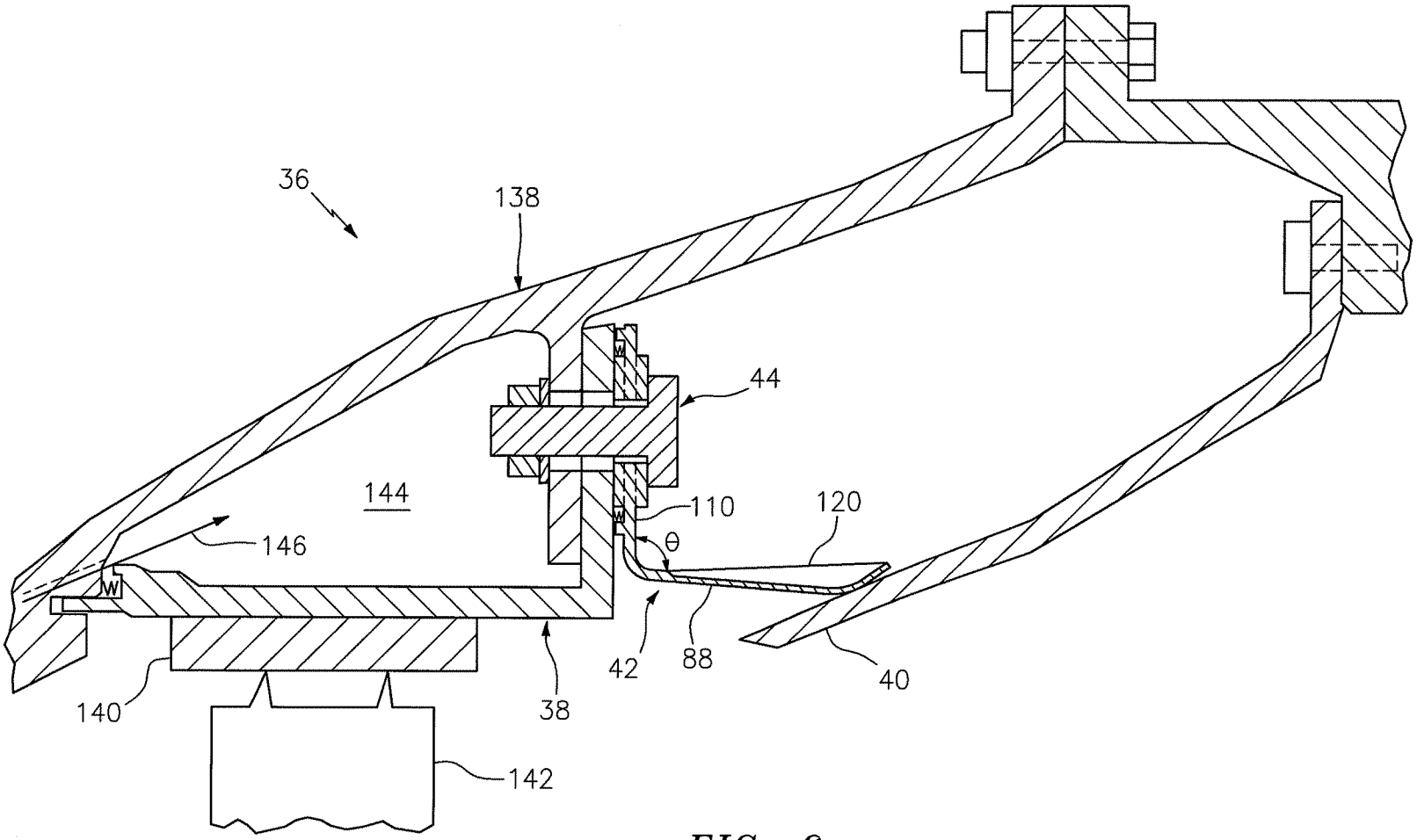
FIG. 6 is a side-sectional illustration of a portion of another seal assembly for the turbine engine of FIG. 1.

Referring to FIGS. 2 and 4, the finger seal 88 is connected to the base 90 at the base inner end 102. The finger seal 88 extends circumferentially between the first side 82 and the second side 84. Referring to FIG. 2, the finger seal 88 is cantilevered from the mount 86. The finger seal 88, for example, extends longitudinally (e.g., axially) from the base 90 to a finger seal end 118. Referring to FIG. 6, the finger seal 88 has a chord 120 that is canted relative to the base second side 110 by an offset angle θ of, for example, between about ninety degrees (90°) and about one hundred and ten degrees (110°). The present invention, of course, is not limited to the foregoing offset angles.

Referring to FIG. 2, the finger seal 88 includes a base portion 122, an intermediate portion 124 and a tip portion 126. The base portion 122 extends longitudinally from the base 90 to the intermediate portion 124. The intermediate portion 124 is arranged and extends longitudinally between the base portion 122 and the tip portion 126. The intermediate portion 124 may be canted relative to the base second side 110 by, for example, between about one hundred and fifteen degrees (115°) and about one hundred and thirty five degrees (135°). The tip portion 126 extends longitudinally from the intermediate portion 124 to the finger seal end 118. The intermediate portion 124 and/or the tip portion 126 each have a thickness 128 that is less than a thickness 130 of the base portion 122 and/or the base 90. The intermediate portion 124 has a substantially straight side-sectional geometry. The tip portion 126 has an arcuate side-sectional geometry.

The finger seal 88 may be configured integral with the base 90. The finger seal 88 and the base 90, for example, may be formed from a piece of sheet metal. Alternatively, the finger seal 88 may be bonded or otherwise attached to the base 90.

Referring to FIGS. 2 and 5, the gaskets include an inner gasket 48 and an outer gasket 50. One or more of the gaskets 48 and 50 may each be configured as a substantially annular ring seal such as, for example, an annular W-seal. The present invention, however, is not limited to any particular gasket types or configurations.

Referring to FIGS. 2 and 4, the flexible seals 42 are arranged circumferentially around the axis 58. The first end 82 of each of the flexible seals 42 is located next to the second end 84 of an adjacent one of the flexible seals 42. Referring to FIGS. 2 and 5, the inner gasket 48 is arranged within a channel that extends radially between the inner retainers 98 and the first bosses 92. The outer gasket 50 is arranged within a channel that extends radially between the outer retainers 100 and the first bosses 92. Referring to FIG. 2, one or more of the first boss surfaces 108 sealingly engage (e.g., contact) the second flange surface 64. The gaskets 48 and 50 are sealingly engaged between the flange 60 and the base 90. The fasteners 44 attach the mount 86 to the flange 60. For example, a shaft 131 of each bolt 52 extends through the respective washer 46 and fastener apertures 68,70 and 96 to a bolt head shoulder 132, which is sealingly engaged with the respective second boss surface 112. Each nut 54 is mated with the respective shaft 131. Each washer 46 is sealingly engaged between the flange first surface 62 and a shoulder 134 of the respective nut 54. Each tip portion 126 sealingly engages the seal land 80. In this manner, the flexible seal 42 may reduce (or prevent) gas leakage through the gap between the first component 38 and the second component 40.

A gap extends axially between each of the inner retainers 98 and the flange second surface 64. A gap extends axially between each of the outer retainers 100 and the flange second surface 64. These gaps enable the base 90 to pivot about one or more of the first bosses 92.

During turbine engine operation, material of one or more of the components of the assembly 36 may thermally expand and contract. This thermal expansion and contraction may cause the size of the gap between the first and the second components 38 and 40 to change. The thermal expansion and contraction may cause distortions (e.g., waves or coning) in the second flange surface 64 and/or the seal land 80. The thermal expansion and contraction may also or alternatively cause changes in the relative spatial orientation of the second flange surface 64 and/or the seal land 80. The flexible seals 42 and/or or one or more of the gaskets 48 and 50, however, may account for such thermally induced changes and distortions in the assembly components. For example, one or more of the finger seals 88 may each move radially up or down with and/or slide along the seal land 80. One or more of the bases 90 may each bend between the bosses 92, 94 to enable the first bosses 92 to remain sealingly engaged with the flange second surface 64. Referring to FIGS. 3 and 4, the shafts 131 may move within the fastener apertures 68 to enable the flange 60 to expand/contract relative to the bases 90, while the apertures 70 maintain the location of the bases 90. Referring to FIGS. 2 and 5, the flexibility of the gaskets 48 and 50 may maintain a seal between the distorted second flange surface 64 and the bases 90.

Figure 7:
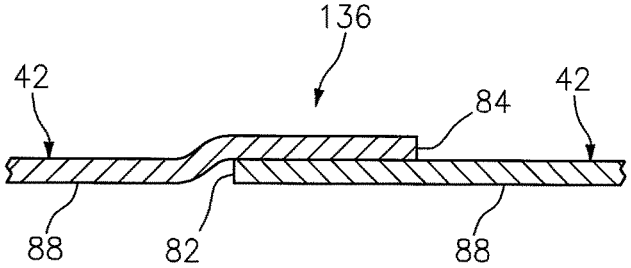
FIG. 7 is a cross-sectional illustration of a seal joint between adjacent flexible seals.

Referring to FIG. 7, in some embodiments, one or more of the flexible seals 42 may each engage an adjacent one of the flexible seals 42 through a seal joint 136 such as, for example, a ship-lap joint. Alternatively or additionally, a seal element may be arranged between the adjacent flexible seals 42. Still alternatively, a controlled leakage gap may extend circumferentially between the adjacent flexible seals 42.

Referring to FIG. 6, in some embodiments, the assembly 36 may also include a turbine engine third component 138. In this embodiment, the third component 138 may be configured as the turbine engine case. The first component 38, on the other hand, may be configured as a blade outer air seal (BOAS), or alternatively any other turbine engine component that may be attached to the third component 138. The first component 38 of FIG. 6 includes an abradable seal element 140 that engages one or more rotor blades 142 within the turbine 30. A cooling air plenum 144 is defined between the first component 38 and the third component 138. This plenum 144 may receive cooling air 146 (e.g., compressor bleed air) to cool the first component 38.

One or more of the components of the assembly 36 may have various configurations other than those described above and illustrated in the drawings. The fastener apertures 68 and 70, for example, may have substantially equal diameters. In addition or alternatively, the fastener apertures 96 may have different diameters to enable movement between the first component 38 and the flexible seals 42. One or more of the bosses 92, 94 may be omitted and/or replaced with floating washers. The intermediate and/or tip portions 124 and 126 of the finger seal 88 may each have substantially the same thickness as the base portion 122 and/or the base 90. One or more of the fasteners 44 may each be configured as a rivet or any other type of fastener. Alternatively or additionally, the mounts may be bonded to the flange. The assembly 36 may include one of the flexible seals, which extends circumferentially around the axis 58.

The present invention therefore is not limited to any particular assembly component configurations.

The assembly 36 may be included in various turbine engine sections and turbine engines other than the one described above. The assembly, for example, may be included in a geared turbine engine where a gear train connects one or more shafts to one or more rotors in a fan section, a compressor section and/or any other engine section. Alternatively, the assembly may be included in a turbine engine configured without a gear train. The assembly may be included in a geared or non-geared turbine engine configured with a single spool, with two spools, or with more than two spools. The turbine engine may be configured as a turbofan engine, a turbojet engine, a propfan engine, or any other type of turbine engine. The present invention therefore is not limited to any particular types or configurations of turbine engines.

The terms "axially", "radially", "inner" and "outer" are used to orientate the components of the assembly described above relative to the turbine engine and its axis 58. A person of skill in the art will recognize, however, one or more of these components may be utilized in other orientations than those described above. The present invention therefore is not limited to any particular assembly spatial orientations.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. An assembly for a turbine engine, comprising:

a turbine engine first component;

a turbine engine second component; and a flexible seal attached to the first component, the flexible seal at least partially sealing a gap between the first component and the second component;

wherein the flexible seal includes a mount and a finger seal that sealingly engages the second component, wherein the mount includes a base and a boss sealingly engaged between the first component and the base, wherein the finger seal is connected to and projects out from the base, and wherein at least the base and the finger seal are included in a monolithic body.

2. The assembly of claim 1, further comprising a fastener that attaches the mount to the first component, and extends through the boss.

3. The assembly of claim 2, wherein the boss comprises a first boss, and the mount further includes a second boss;

the first boss and the second boss are arranged on opposing sides of the base;

the fastener further extends through the base and the second boss; and the first boss and the second boss are sandwiched between a head of the fastener and the first component.

4. The assembly of claim 2, wherein the boss comprises a washer that is bonded to the base.

5. The assembly of claim 2, further comprising:

a washer sealingly engaged between a flange and a first shoulder;

wherein the first component includes the flange, and the fastener includes the first shoulder and a second shoulder that sealingly engages the mount; and wherein the fastener attaches the mount to the flange, and extends through mount, the flange and the washer between the first shoulder and the second shoulder.

6. The assembly of claim 2, further comprising:

a second fastener that attaches the mount to the first component;

wherein the fastener has a shaft diameter that is approximately equal to a shaft diameter of the second fastener;

wherein the fastener extends through a first aperture in the first component, and the second fastener extends through a second aperture in the first component; and wherein the first aperture has a diameter that is different than a diameter of the second aperture.

7. The assembly of claim 2, further comprising:

a first flange and a second flange;

wherein the first component includes the first flange, and the first flange is arranged between the second flange and the mount; and wherein the fastener connects the first flange, the second flange and the mount together.

8. The assembly of claim 1, wherein the finger seal is cantilevered from the mount.

9. The assembly of claim 1, wherein the flexible seal is one of a plurality of flexible seals that are attached to the first component and arranged circumferentially around an axis.

10. The assembly of claim 9, wherein a first of the flexible seals engages a second of the flexible seals through a seal joint.

11. The assembly of claim 1, further comprising:

a gasket sealingly engaged between the first component and the mount;

wherein the mount extends radially between a first end and a second end; and wherein the gasket is located radially between the first end and the boss.

12. The assembly of claim 11, further comprising:

a second gasket sealingly engaged between the first component and the mount;

wherein the second gasket is located radially between the second end and the boss.

13. The assembly of claim 11, wherein the mount further includes a retainer;

a gap extends axially between the first component and the retainer; and the gasket is arranged radially between the boss and the retainer.

14. The assembly of claim 1, wherein the first component comprises a first turbine engine case, and the second component comprises a second turbine engine case.

15. The assembly of claim 1, wherein the first component comprises a blade outer air seal, and the second component comprises a turbine engine case.

16. An assembly for a turbine engine, comprising:

a turbine engine first component including a flange;

a turbine engine second component;

a flexible seal at least partially sealing a gap between the first component and the second component, wherein the flexible seal includes a mount and a finger seal that sealingly engages the second component and is cantilevered from the mount, wherein the mount includes a base and a washer that is sealingly engaged between the flange and the base, and wherein at least the base and the finger seal are formed together as a monolithic body; and a fastener that attaches the mount to the flange, the fastener including a bolt and a nut threaded onto the bolt, wherein the bolt extends through the washer and the base.

17. The assembly of claim 16, wherein the washer is bonded to the base and forms a boss.

18. An assembly for a turbine engine, comprising:

a flexible seal extending circumferentially at least partially around an axis, and including a mount and a finger seal;

the mount including a base, a plurality of bosses and a plurality of fastener apertures, wherein the base extends radially between an inner end and an outer end, the bosses are arranged circumferentially around the axis, and each of the fastener apertures extends axially through the base and a respective one of the bosses; and the finger seal is arranged at the inner end, and is cantilevered from the mount;

wherein at least the mount and the finger seal are integrally formed together as a monolithic body.

19. The assembly of claim 18, wherein the mount further includes a retainer and a channel that extends radially between a first of the bosses and the retainer; and the retainer has an axial thickness that is less than an axial thickness of the first of the bosses.

20. The assembly of claim 19, wherein the mount further includes a second retainer and a second channel that extends radially between the first of the bosses and the second retainer; and the second retainer has an axial thickness that is less than the axial thickness of the first of the bosses.

* * * * *